United States Patent [19]

Heytmeijer et al.

[11] 3,993,838

[45] Nov. 23, 1976

[54] WAX OR PLASTIC COATED PHOSPHOR GRAINS

[75] Inventors: Herman R. Heytmeijer, Whippany; Elmer S. Panaccione, N. Arlington, both of N.J.

[73] Assignee: The United States of America as represented by the Secretary of the Interior, Washington, D.C.

[22] Filed: Mar. 3, 1975

[21] Appl. No.: 554,838

[52] U.S. Cl. ..... 428/403; 102/87; 149/19.91; 427/212; 427/221; 428/407

[51] Int. Cl.[2] ..... B32B 5/16

[58] Field of Search ..... 428/93, 403, 500, 484, 428/917, 407; 264/7; 149/3, 16, 19, 18, 29; 427/220, 221, 64, 212, 215; 252/301.4 R, 301.4 P; 102/27

[56] References Cited

UNITED STATES PATENTS

| | | | |
|---|---|---|---|
| 3,321,426 | 5/1967 | Dorsey | 264/7 |
| 3,488,711 | 1/1970 | Dany et al. | 427/220 |
| 3,554,354 | 12/1970 | Kachel | 427/64 |
| 3,657,027 | 4/1972 | Horsey et al. | 149/29 |
| 3,682,725 | 8/1972 | Kelly | 102/27 R |
| 3,772,099 | 11/1973 | Ryan et al. | 427/157 |
| 3,774,541 | 11/1973 | Bratton | 102/27 R |
| 3,835,782 | 9/1974 | Griffith et al. | 149/18 |

*Primary Examiner*—Marion E. McCamish
*Assistant Examiner*—P. J. Thibodeau
*Attorney, Agent, or Firm*—William S. Brown; Donald R. Fraser

[57] ABSTRACT

Phosphor grains coated with wax or plastic coating compositions comprising hydrocarbons are useful as tagging phosphors for explosives. The coating composition can incorporate UV opacifiers, coloring agents or antistatic agents, or mixtures of them.

4 Claims, No Drawings

WAX OR PLASTIC COATED PHOSPHOR GRAINS

CROSS REFERENCE TO RELATED APPLICATIONS

Reference is made to application Ser. No. 554,834 to Heytmeijer and Panaccione, filed Mar. 3, 1975, now U.S. Pat. No. 3,961,106 relating to a spray method and apparatus for producing wax or plastic coated phosphor grains.

BACKGROUND OF THE INVENTION

This invention relates to wax or plastic coated phosphor grains adapted to be employed in explosives as tagging agents. The coating comprises hydrocarbons and serves to lessen the sensitivity of an explosive/phosphor grain mixture. The coating may contain UV opacifying agents, coloring agents or antistatic agents, or mixtures thereof.

SUMMARY OF THE INVENTION

Hard phosphor grains effectively serve to tag explosives to identify them so that the source can be traced after an explosion. However, they increase the sensitivity of the explosive to impact and friction. Coating the phosphor grains with a coating comprising a wax or plastic, and preferably comprising hydrocarbons, serves to lessen the sensitivity of an explosive composition containing the tagging phosphors.

In order to mask the coated phosphor grains, a UV opacifier or a coloring agent may be added to the coating composition. An important additive is an antistatic agent to eliminate electrostatic charges which are generated when coatings such as polyethylene are employed. Electrostatic charges are dangerous in the manufacture of explosives and in addition are harmful in the manufacturing process by attracting foreign matter, etc.

Among the objects of the invention are:

1. To provide a hard phosphor grain coated with wax or plastic and useful for tagging explosives.
2. To provide a coating layer in (1) of a wax or plastic composition having a high specific heat.
3. To provide a coating layer as in (2) wherein the wax or plastic composition comprises a hydrocarbon.
4. To provide a coating layer as in (3) comprising a low molecular weight polyethylene, or paraffin and microcrystalline wax with one or more of carnauba wax, low molecular weight polyethylene or ethylene/vinyl copolymer.
5. To provide a coating as in (3) wherein the coating is a paraffin wax coated with graphite.
6. To provide a coating as in (1) to (5) wherein a UV opacifier or a coloring agent or an antistatic agent or mixtures thereof is included.

Further objects will become apparent from the following description of the invention and the claims appended thereto.

U.S. Pat. No. 3,772,099, issued Nov. 13, 1973 to Fredrick M. Ryan and Robert C. Miller and assigned to Westinghouse Electric Corporation is incorporated by reference herewith. This patent describes fluorescent tagging means for explosives to provide post detonation information comprising (1) a spotting phosphor which can be excited by UV radiation to provide a bandtype emission and (2) a coding phosphor which emits a line-type emission.

Both phosphors are incorporated into cemented phosphor grains of fine particle size which are dispersed in the explosive. After an explosion, phosphor grains can be located by UV irradiation of the spotting phosphor and the information on the coding phosphor can then be decoded.

The spotting phosphor is typically an inexpensive phosphor emitting over a fairly broad region of the visible spectrum and is used primarily as a means of locating the phosphor grain. The coding phosphor contains information about the explosive, such as the manufacturer and the type. This information is contained in a binary code which is established by the presence (or absence) of the specific fluorescence emission of each coding phosphor. For maximum recovery after detonation consistent with minimum grain concentration in the explosive, the optimum particle size is about 250–400 microns. While very effective in their intended use, it has been found that the hard abrasive phosphor grains greatly increase the impact and friction sensitivity of the explosive. Obviously, this poses a serious and dangerous problem particularly when the grains are to be added to normally sensitive explosives such as gelatinous type dynamites. We have discovered that the application to the grains to a wax, modified wax or plastic coating of sufficient thickness can eliminate the sensitizing effect of the phosphor particles.

While various plastics and the petroleum, animal or vegetable waxes and mixtures thereof can be used to coat the particle, for best results the choice is limited to those that have such desirable properties as high melting point, strength, hardness, resistance to blocking (flow freely), lubricity and compatibility with the explosive. The melting point of the coating should be at least 70° and preferably about 100° C. to prevent softening of the coating and agglomeration of the coated grains during periods of high ambient temperature. Since the coated grains may have to be stored or transported under conditions of high ambient temperatures, the coating should retain its integrity and not become sticky below about 66° C. With regard to such properties as strength, hardness and lubricity, the coating material must be hard and strong enough to withstand easy deformation and rub-off, yet soft enough to provide good lubricity under impact.

It is known that there is a correlation between impact sensitivity of an explosive/additive mixture and the specific heat of the additive. Accordingly, aliphatic hydrocarbons such as paraffin and microcrystalline waxes and low molecular weight polyethylenes are preferred as coaters because they have the highest hydrogen-to-carbon ratio obtainable from organic compounds and thus have high specific heat values. However, a hard natural wax such as carnauba, while not as preferred, is useful in coating the phosphors.

A number of methods for applying a coating on the phosphor grains are suitable, including tumble coating with waxes and polymerization encapsulation in polyethylene. Using the former method wherein molten coater material is sprayed on a tumbling mass of grains, a 40% by weight of carnauba wax coating to the grains was applied. Vigorous agitation of the grain mass is required to prevent formation of aggregates. Above a 40% coater weight undesirable agglomeration occurs despite such agitation. In polymerization encapsulation, processing problems are caused by settling of the heavy phosphor grains in the carrier liquid and by inadequate build-up of polymer on the grains.

The most satisfactory method for applying a relatively heavy coating on the phosphor grains has been determined to be that of spraying mixtures of the solid particles with molten coating material. This method, wherein the grain/melt mixture is ejected from a venturi-type nozzle by means of air or other suitable gas to form a spherical particle is the subject of our copending application Ser. No. 554,834, filed Mar. 3, 1975.

The coating material found most suitable is low molecular weight polyethylene homopolymers such as AC-Polyethylene 6 and AC-Polyethylene 6,17 made by the Allied Chemical Co. Straight paraffin waxes and microcrystalline waxes generally become sticky below about 66° C. and are therefore not desirable where higher ambient temperatures are expected. However, mixtures of these waxes with one or more of carnauba wax, low molecular weight polyethylene and ethylene/-vinyl acetate copolymer, such as Alathon EVA 3180 made by the Dupont Co., are acceptable in this regard. Also, powdered graphite applied to the outer coating in concentrations of about 1% by weight of the coated grains serves to prevent agglomeration at high temperature for several hours.

Admixture with carnauba wax produces tough, rather hard coatings, while incorporation of low molecular weight polyethylenes produce higher melting point and often tough coatings. These may be present in amounts of from 41 to 73 % by weight in the wax mixture. Incorporation of more than about 12% by weight of ethylene/vinyl acetate copolymer is to be avoided when the spray coating method is employed since this results in the production of much fine fibers (cobwebbing), rather than coated spheres.

The coated phosphor grains as received from the coating step are not of uniform diameter. Optimum size for incorporation into an explosive is the fraction −12 to +35 mesh or 417 to 1400 microns. The coarser and finer fractions may be recycled to the coating stages.

The tables below show the effects of various coatings on phosphor grains on explosive sensitivity. The drop weight test referred to therein is described in the Bureau of Mines publication IC 8541 entitled Methods for Evaluating Explosives and Hazardous Materials. Briefly, a 54 mg sample of explosive has a 2 kg intermediate weight placed over it and is struck by a 2 kg drop weight from various heights. The height from at which an explosion occurs 50% of the time is $H_{50}$.

In the sliding rod test, a 100 mg sample of explosive is placed on a 2 inch diameter smooth steel anvil located at the bottom of a 60° inclined aluminum trough, having a maximum usable height of 55 inches. A 10 lb impact tool having a hemispherical noze is slid down the incline from various heights to contact the explosive. This test measures both friction and impact sensitivity.

Table 1 shows the results of drop weight test on Gelobel AA containing various additives:

TABLE 1

Sensitization of Gelobel AA by Certain Additives as Measured by the Drop Weight Test

| Additive | Drop Weight $H_{50}$ (inches) |
|---|---|
| None | 44.5 |
| Uncoated phosphor grains | 10.8 |
| Poorly coated phosphor grains | 21.0 |

TABLE 1-continued

Sensitization of Gelobel AA by Certain Additives as Measured by the Drop Weight Test

| Additive | Drop Weight $H_{50}$ (inches) |
|---|---|
| Well coated grains* | 39.7 |

*Coating consists of 5 parts by weight of a mixture of 30 p. Eskar MY-65[1], 70 p. carnauba wax, and 10 p. Alathon EVA No. 3180[2].
[1]A paraffin wax available from the American Oil Company
[2]Available from the Dupont Company.

1) A paraffin wax available from the American Oil Company
2) Available from the Dupont Company.

Poorly coated grains, i.e. those which pass through a 35 mesh screen or are retained on a 12 mesh screen have a definite sensitizing effect on sensitive explosives such as Gelobel AA dynamite, a gelatine dynamite available from the Dupont Co. The fines comprise small wax or resin balls without phosphors, while the coarse fraction screened from spraying operation contain fibrous material caused by cobwebbing.

As indicated above, low molecular weight homopolymers of polyethylene are the preferred coating materials. These materials have the following typical properties, AC-617 and AC-6 being polyethylene polymers shown by way of illustration.

TABLE 2

| Homo-polymer Poly-ethylene | Softening Point, ° C (ASTM E-28) | Hardness, dmm (ASTM D-5) | Viscosity – cps 140° C, Brookfield |
|---|---|---|---|
| AC-617 | 102 | 7.5 | 145 |
| AC-6 | 106 | 3.5 | 200 |

The above properties provide relatively hard, non-blocking (non-sticking) coatings of high melting point and good lubricity. They also provide melts are not excessively low in viscosity and when properly sprayed give practically no cobwebbing. When sprayed as melts containing 1 part by weight of grains to 5 parts by weight of polymer, the finished screened product consists of small almost perfectly shaped balls each containing one or more phosphor grains. Tests have shown that the degree of sensitization produced by these coated grains is comparable to that produced by common explosive ingredients such as fine ammonium nitrate, microballoons and limestone. In fact, addition of grains coated with AC-6 polyethylene actually desensitize the explosive.

Table 3 below shows the relative sensitization of Gelobel AA dynamite by phosphor grains coated with AC-617 or AC-6 polyethylene or with a modified wax of the composition below as measured by the drop weight test:

| Parts | Components |
|---|---|
| 30 | Microcrystalline wax; Eskar MY65, available from the American Oil Company |
| 70 | Carnauba wax |
| 10 | Low molecular weight polyethylene homopolymer; Bareco Polywax No. 655, available from the Petrolite Company |
| 10 | Ethylene/vinyl acetate copolymer; Alathan EVA No. 3180, available from the Dupont Company |

TABLE 3

| Sensitization of Gelobel AA by Coated Phosphor Grains as Measured by the Drop Weight Test | | | | |
|---|---|---|---|---|
| Dopant, Type of Coating and Mesh Size | Doping Level in Testing Sample | $H_{50}$ Undoped[5] | $H_{50}$ Doped | Normalized Sensitization[3] |
| AC-617; thru 25 on 35 mesh | 5 particles | 45.6 | 36.9 | 1.24 |
| Modified Wax; thru 12 on 25 mesh | " | " | 43.0 | 1.06 |
| AC-6; thru 12 on 25 mesh | " | " | 45.3 | 1.00 |
| AC-617; thru 12 on 25 mesh | " | " | 50.5 | .90 |
| Modified Wax; thru 25 on 35 mesh | " | " | 52.5 | .87 |
| AC-6; thru 25 on 35 mesh | " | " | 56.0 | .81 |
| Uncoated phosphor grains | " | 47.5 | 10.8 | 4.40[4] |

[3]$H_{50}$ (undoped)/$H_{50}$ (doped)
[4]Previous result included for comparison
[5]$H_{50}$ = height of drop in cm of a standard weight for which explosion occurs in 50% of the time By way of comparison, Table 4 shows the relative sensitization of Gelobel AA with common dynamite ingredients:

TABLE 4

| Relative Sensitization of Gelobel AA by Common Dynamite Ingredients as Measured by the Drop Weight Test[6] | | | | |
|---|---|---|---|---|
| Ingredient | Doping level | $H_{50}$ Undoped | $H_{50}$ Doped | Normalized Sensitization[7] |
| 1. Granulated salt | 5 particles | 45.5 | 28.5 | 1.6 |
| 2. Fine $NH_4NO_3$ | " | 45.5 | 35.8 | 1.3 |
| 3. Limestone | " | 32.0 | 27.0 | 1.2 |
| 4. Microballoons | " | 45.5 | 42.5 | 1.1 |
| 5. Flake salt | " | 39.7 | 39.1 | 1.0 |
| 6. Sulphur | " | 39.7 | 49.0 | .8 |
| 7. Coarse $NH_4NO_3$ | " | 39.7 | 49.5 | .8 |
| 8. Fine $NaNO_3$ | " | 32.0 | 43.0 | .7 |
| 9. Coarse $NaNO_3$ | " | 32.0 | 46.6 | .7 |

[6]Based on 20 trials for each ingredient
[7]$H_{50}$ (undoped)/$H_{50}$ (doped)

Table 5 shows the excellent results obtained with a doped nitroglycerine-ethylene glycoldinitrate (NG-EGDN) (60-40) explosive.

TABLE 5

| Sliding rod test results of NG-EGDN (60–40) Doped with Coated Phosphor Grains | | |
|---|---|---|
| Dopant (coated phosphor grains), Type of Coating and Mesh Size | Maximum Stimulus level (inches) | Results[8] |
| AC-617; thru 25 on 35 mesh | 55 | No go |
| Modified Wax; thru 12 on 25 mesh | " | " |
| AC-6; thru 12 on 25 mesh | " | " |
| AC-617; thru 12 on 25 mesh | " | " |
| Modified Wax; thru 25 on 35 mesh | " | " |
| AC-6; thru 25 on 35 mesh | " | " |

[8]Results of 10 trials for each coating at the stimulus level indicated

These data show that separation into narrow product size is not necessary but that the entire 12 to 35 mesh range is acceptable.

ADDITIVES TO COATING COMPOSITION

Where the coating is transparent to UV light, the phosphor grains would be clearly identified in an explosive composition on UV irradiation. Obviously this phenomenon would greatly aid a would-be terrorist in removing the tagging phosphors from the explosive. Addition of a combustible UV opacifier to the coating composition would render the grains essentially opaque to UV transmission. In an explosion, the coating together with the opacifier will burn in the reactive atmosphere leaving behind the fluorescent phosphor grains.

The addition of about 25% by weight of carbon black or about 4% by weight of Cyasorb UV 531 Light Absorber, a hydroxy oxy benzophenole, made by American Cyanamide, to polyethylene renders the latter essentially opaque to UV transmission.

The coated grains may be camouflaged by means of dyes or pigments to make their visual identification in an explosive more difficult. Certain pigments such as Chromophthal Yellow 3G, Chromophthal Red BR and Irgalite Blue LGLD, available from Ciba-Geigy Corporation, are compatible with polyethylene are effective coloring agents. Admixture of 2% by weight of the dyes in the coating composition serves to color them effectively and in addition gives substantial UV masking as high as 90%, as well.

In addition to being used to mask the presence of the phosphor grains, different colors can be used for identification purposes such as distinguishing between permissible and non-permissible explosives to aid in avoiding errors at the explosive manufacturing plant; or to identify different manufacturers. Permissible explosives are those which by regulation are allowed to be used in U.S. coal mines because of their low probability of igniting methane-air mixtures; Title 30 CFR, Chapter 1, Subchapter C, Part 15.

In addition to, or instead of UV masking agents and dyes, antistatic agents can be added to the coatings on the phosphor grain substrate. It was found that electrostatic changes are generated where certain coatings such as polyethylene are employed.

These changes can present a danger in the manufacturing process since a spark may result in an explosion. Accordingly, the need to eliminate electrostatic charges in the coated phosphor grains used in tagging explosives is critical. In addition to the safety aspect, electrostatic charges create a problem in the size separation of the grains by causing seive blinding and affect the general handling of the grain by attracting extraneous material, etc.

We have found that incorporating an antistatic agent in the coated phosphor tagging grains provides an effective way of lessening the safety hazard and improves the seiving and handling characteristics of the grains. Antistatic agents hitherto used in plastics such as alkyl sulfate-type, alkylaryl sulfate-type, alkylamine sulfate-type, alkyl phosphate-type, imidazoline-type, a quaternary ammonium salt of fatty acid-type, ethanolamide-type, polyoxyethylenealkyl-amine or -amide-type, sorbitan-type, polyoxyethylenealkylarylether-type, fatty acid glyceride-type, higher fatty acid amide-type and betaine-type may be used in this invention.

Such antistatic agents include polyoxyethylene-laurylether sulfuric acid ester salt, polyoxyethylene-1-nylphenolether sulfuric acid ester salt, amine salt of stearic acid, polyoxyethylenestearylamide, poly-oxy-propylene-laurylamide, trimethylcetylammonium chloride, dilauryl-dimethylammonium chloride, 1-hydroxyethyl-2-alkylimidazoline, bistriazinylaminobibenzyl, sorbitan oleate, sorbitan laurate, monoglyceride or diglyceride of stearic acid, polyoxyethylene stearylester and polyoxyethylene-sorbitan stearate, and it is recognized that each of them achieves similar results.

Two specific antistatic agents useable are Kenamide (a product of Humko Co.) and Armostat 310 (a product of Armak Co.), which are higher fatty acid amides. The addition of 0.25–0.8 weight percent and preferably 0.5 weight percent of Kenamide or Armostat 310 as antistatic agents to polyethylene coated phosphor grains served to eliminate electrostatic charges and to improve manufacturing processing.

In general, the amount of additive required will be relatively small and the minimum effective quantity can be readily determined in each case.

What is claimed:

1. A coated phosphor grain adapted for incorporation in an explosive material to serve as a tagging agent and to furnish information thereon;

said coating having a melting point of at least 70° C and consisting essentially of low molecular weight polyethylene and an antistatic agent.

2. The coated phosphor of claim 1 wherein the coating includes a UV opacifier.

3. The coated phosphor of claim 1 wherein the coating includes a coloring material as a camouflaging agent.

4. The coated phosphor of claim 1 wherein the antistatic agent comprises a long chain fatty acid amide.

* * * * *